United States Patent [19]

Voigt

[11] 4,323,009

[45] Apr. 6, 1982

[54] ARTICLE CRUSHING DEVICE

[76] Inventor: John E. Voigt, 20153 Santa Maria Ave., #21, Castro Valley, Calif. 94546

[21] Appl. No.: 184,490

[22] Filed: Sep. 5, 1980

[51] Int. Cl.[3] ..... B30B 1/04; B30B 9/32

[52] U.S. Cl. ..... 100/240; 74/105; 100/283; 100/293; 100/902

[58] Field of Search ..... 100/DIG. 2, 293, 240, 100/281, 283, 285, 179, 280, 284; 74/106, 105, 516

[56] References Cited

U.S. PATENT DOCUMENTS

| | | | |
|---|---|---|---|
| 1,082,454 | 12/1913 | Swan | 100/240 |
| 2,603,270 | 7/1952 | Voigt | 100/DIG. 2 |
| 2,603,271 | 7/1952 | Heymers | 100/DIG. 2 |
| 3,011,429 | 12/1961 | Kuslich | 100/283 X |
| 3,411,722 | 11/1968 | Webber | 100/DIG. 2 |
| 3,780,647 | 12/1973 | Reimers | 100/293 X |
| 4,143,595 | 3/1979 | Carlson | 100/DIG. 2 |
| 4,168,661 | 9/1979 | Wigdahl | 100/293 X |
| 4,188,875 | 2/1980 | Fabbri | 100/293 |
| 4,197,796 | 4/1980 | Salatka | 100/293 |
| 4,228,734 | 10/1980 | Parrish | 100/DIG. 2 |

*Primary Examiner*—Billy J. Wilhite

*Attorney, Agent, or Firm*—Robert R. Tipton

[57] ABSTRACT

An article crushing device having a base support on which is mounted an anvil bracket for supporting the item to be crushed includes a crushing piston disposed in a cylindrical housing which is adapted to slidably move therein. An operating handle, pivotally connected to the base support, is provided with a means connecting the operating handle to the piston for progressively increasing the ratio of force on the piston to moment on the operating handle as the piston approaches the anvil bracket during the crushing operation of the article.

8 Claims, 4 Drawing Figures

ARTICLE CRUSHING DEVICE

BACKGROUND OF THE PRIOR ART

This invention relates generally to compacting devices and in particular to devices for crushing or compacting metallic objects.

The various can crushing devices of the prior art included such simple apparatus as an operating handle providing a simple linear ratio leverage force to an article to thereby crush the item. The force applied to the can was generally the common single fulcrum lever arm arrangement for multiplying force which provided a constant ratio of applied force to operating handle force or moment.

Other can crushing devices used various modifications of the simple lever arm force multiplying technique with added features to reduce the crushing force by first collapsing the sides of the can to reduce the initial columnar load stresses.

Some devices also used bell-crank type lever arms for amplifying the force necessary to crush the object. Still other devices used a lever arm arrangement in which the fulcrum point was moved by stages as the can was crushed.

Still other can crushing devices provided brackets which would collapse the sides of the can or provide a rotary or twisting motion as the can was being crushed purportedly to reduce the crushing force.

In all cases, the force being applied to the can was generally constant. That is, the ratio of force being applied to the operating handle relative to the crushing force was constant during the travel of the crushing head or piston throughout the crushing operation.

SUMMARY OF THE INVENTION

During the can crushing operation, after an initial peak force required to overcome the resistance to columnar loading, the forces required to crush the can are initially relatively low and tend to increase as the can metal becomes more compact during the crushing operation. Thus the force on the operating handle must be increased proportionally in order to compress the article to its minimum volumetric dimension.

The article crushing apparatus of the present invention corrects for this increase in crushing force by providing a base support upon which an anvil bracket if attached and on which is also attached a means defining a cylindrical housing having a means defining an opening adapted to receive the article to be crushed, with a crushing piston disposed within the housing adapted to move slidably toward and away from the anvil bracket. An operating handle is pivotally connected to the base support with a means connecting the operating handle to the piston for progressively increasing the ratio of force on the piston to the force or moment on the operating handle as the piston approaches the anvil bracket.

It is, therefore, an object of the present invention to provide an article crushing apparatus.

It is a further object of the present invention to provide an article crushing apparatus in which the ratio of operating handle force to crushing force is progressively increased as the crushing operation progresses to completion.

It is a further object of the present invention to provide an article crushing device in which mechanical linkage members are utilized to progressively increase the ratio of operating handle force to crushing force as the crushing operation approaches completion.

These and other objects of the present invention will become manifest upon study of the following detailed description when taken together with the drawings.

DESCRIPTION OF THE PREFERRED EMBODIMENT

Figure 1:
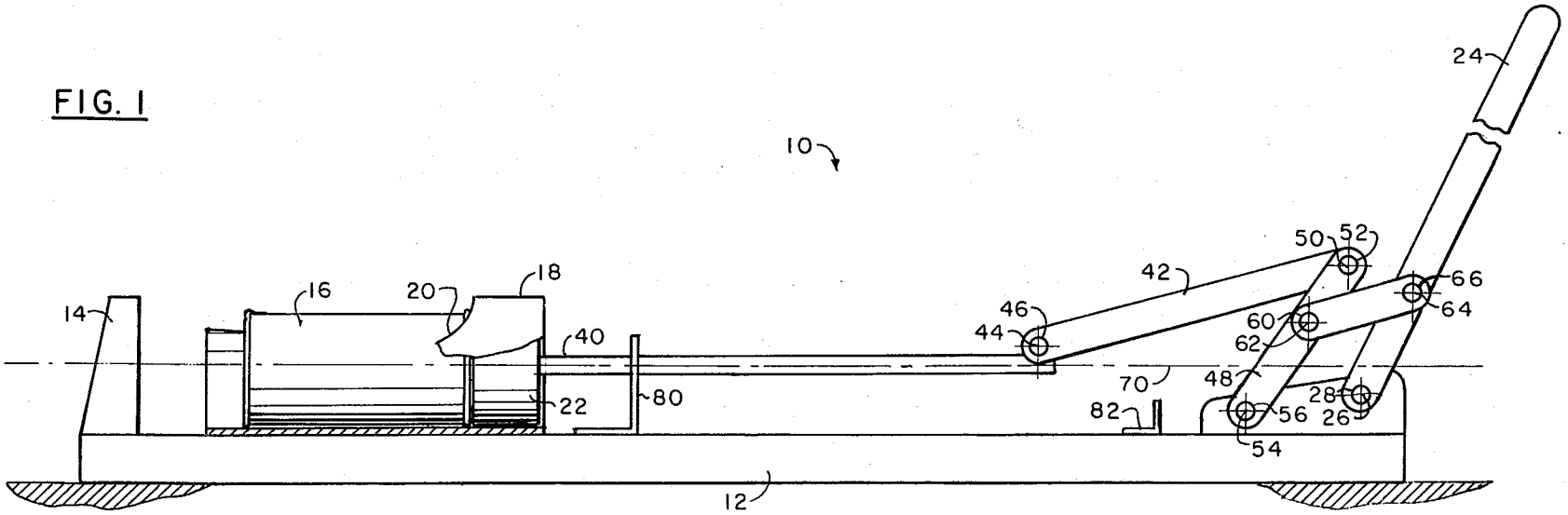
FIG. 1 is a elevational, partial cut-away view of the article crushing apparatus of the present invention shown with the crushing piston at the beginning of its crushing operation.

With reference to FIG. 1, the article crushing apparatus 10 of the present invention comprises, basically, a base support 12, on which is attached an anvil bracket 14 adapted to support the article 16 to be crushed. Also attached to base support 12 is cylindrical housing 18 adapted to receive the article to be crushed through opening 20. A crushing piston 22 is disposed within housing 18 and adapted to be slidable therein. Operating handle 24, disposed at the other end of base support 12 distal anvil bracket 14, is pivotally connected to base support 12 at pivot point 26 using pivot pin 28.

Operating handle 24 is connected to crushing piston 22 by a series of various linkage members pivotally connected to each other in a manner whereby the crushing force exerted by piston 22 is progressively increased as piston 22 approaches anvil 14 without appreciably increasing the force applied to operating handle 24. In other words, the arrangement of the linkage members is such that the ratio of force on crushing piston 22 to moment or force on operating handle 24 is progressively increased as piston 22 approaches anvil bracket 14.

In particular, with reference to FIG. 1, the linkage members comprise a first linkage member 40 which is connected at one end to crushing piston 22 and at its other end is pivotally connected to one end of second linkage member 42 at pivot point 44 by pivot pin 46.

Second linkage member 42 is connected at its end distal pivot point 44, to one end of third linkage member 48 at pivot point 50 by pivot pin 52.

Third linkage member 48 is connected at its end distal pivot point 50, to base support 12 at pivot point 54 by pivot pin 56.

One end of fourth linkage member 58 is pivotally connected to third linkage member 48, between pivot points 50 and 54, at pivot point 60 using pivot pin 62. The other end of fourth linkage member 58 is pivotally connected to operating handle 24 at pivot point 64 by pivot pin 66.

Although the arrangement of pivot points of operating handle 24 to base support 12 and third linkage member 48 to base support 12 in combination with fourth linkage member 58 pivotally connected between handle 24 and third linkage member 48, appears to be a parallelogram, it is, in fact, not exactly a true parallelogram. The distance between pivot point 60 and pivot 54 is in, in fact, slightly greater than the distance between pivot point 64 and pivot point 26. Also, the distance between pivot point 60 and pivot point 64 is less than the distance between pivot point 54 and pivot point 26.

In fact, the actual distances between pivot points of the linkage members for a typical operating device are as follows

TABLE 1

| Linkage Member | Pivot Points | Distance Between Pivot Points |
|---|---|---|
| Second Linkage Member 42 | 46 and 52 | 9¼ inches |
| Third Linkage Member 48 | 60 and 54 | 3¼ inches |
| Fourth Linkage Member 58 | 60 and 40 | 3 inches |
| Operating Handle 24 | 64 and 24 | 3⅜ inches |
| Base Support 12 | 54 and 26 | 3⅛ inches |

Although the difference in distance between pivot points is relatively small, it is still significant to produce an increase in leverage as crushing piston 22 approaches anvil 14.

To maintain first linkage member 40 in alignment with the longitudinal axis 70 of cylindrical housing 18 and crushing piston 22, a guide bracket 80 is attached to base support 12 and is adapted to slidably engage first linkage member 40 and guide it in alignment with longitudinal axis 70 of housing 18.

A stop bracket 80 is attached to base support 12 to arrest the motion of handle 24 before it reaches cylinder 18 or the other operating parts of article crusher 10.

It will also be noted that pivot point 26 and pivot point 66 are offset relative to longitudinal axis 70 of cylindrical housing 18 with pivot point 26 disposed closer to axis 70 than pivot point 54.

To operate the apparatus of the present invention, a can or article to be crushed is placed in cylindrical housing 18 through port or opening 20 with crushing piston 20 pulled back to its fartherst position from anvil 14 as shown in FIG. 1.

In this position, it can be seen that linkage members 40, 42, 48 and 58 are in a position which gives a relatively low ratio of crushing piston 22 force to operating handle force or moment.

Figure 2:
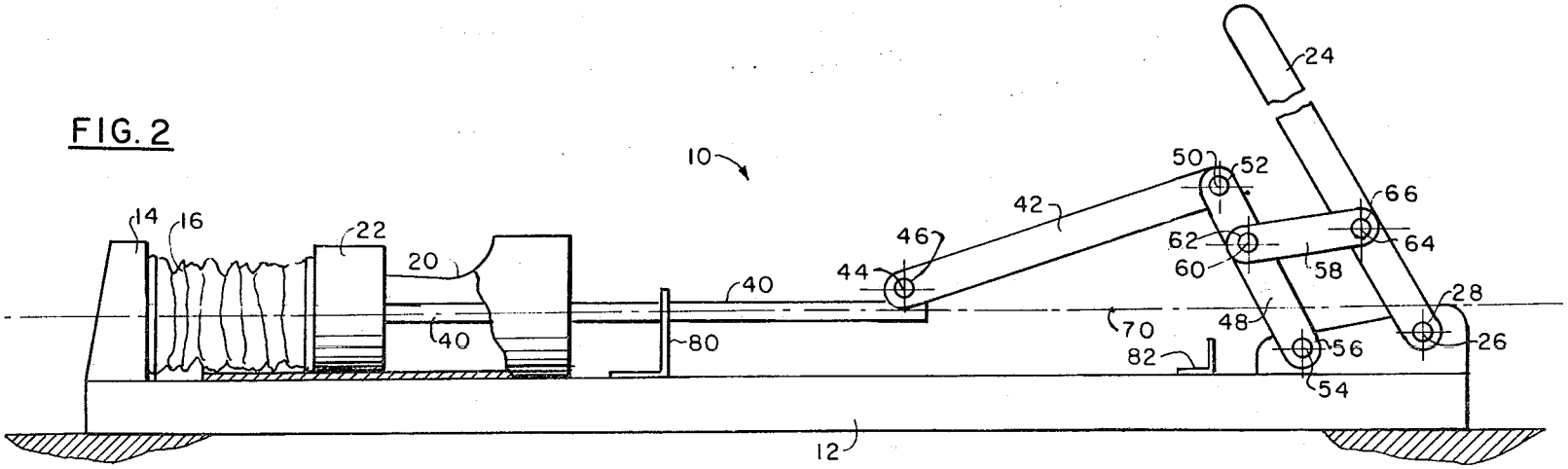
FIG. 2 is an elevational, partial cut-away view of the article crushing apparatus of the present invention showing the crushing piston and apparatus approximately midway through the crushing operation.

With reference to FIG. 2, as operating handle 24 is rotated to a position in which crushing piston 22 is moved toward anvil 14, second linkage member 42, third linkage member 48 and fourth linkage member 58 are advanced to a position whereby their leverage is increased. For example, as the angle defined by second linkage member 42 and third linkage member 48 becomes more obtuse, the force applied to crushing piston 22 is increased a proportionally greater amount by virtue of the mechanical advantage of the linkage.

In a like manner, the mechanical advantage offered by the linkage arrangement of third linkage member 48, fourth linkage member 58 and the operating handle linkage between pivot points 64 and 26, also becomes greater, since, as the angle defined by fourth linkage member 58 and operating handle 24 between pivot points 64 and 26 becomes more obtuse, a greater force will be exerted on third linkage member 48.

Figure 3:
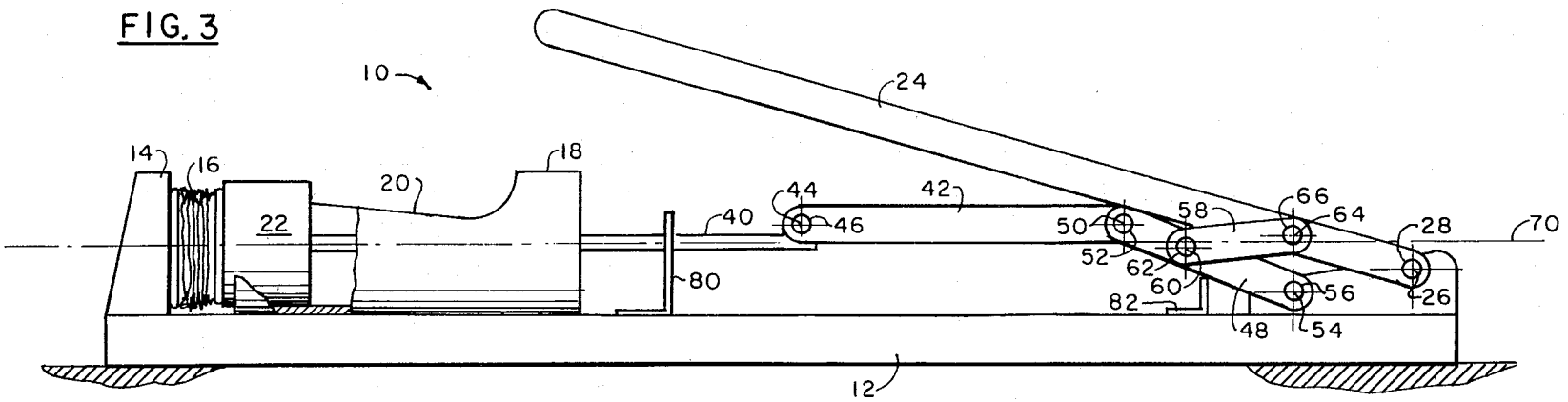
FIG. 3 is an elevational, partial cut-away view of the article crushing apparatus of the present invention showing the crushing piston proximate the end of its travel in its crushing operation.

As can be seen in FIG. 3, as crushing piston 22 further approaches anvil 14 with operating handle 24 nearing the completion of its motion, operating handle 24 now rests against the end of third linkage member 48 proximate pivot point 50. This, of course, creates a further mechanical advantage of operating handle 24 to exert a greater force on crushing piston 22.

Thus, as operating handle 24 proceeds from its initial position shown in FIG. 1 to its final position shown in FIG. 3, there is an increasing mechanical advantage utilizing the linkage system between crushing piston 22 and operating handle 24 whereby the ratio of force exerted by crushing piston 22 to force or moment on operating handle 24 is progressively increased as crushing piston 22 moves toward anvil bracket 14.

Figure 4:
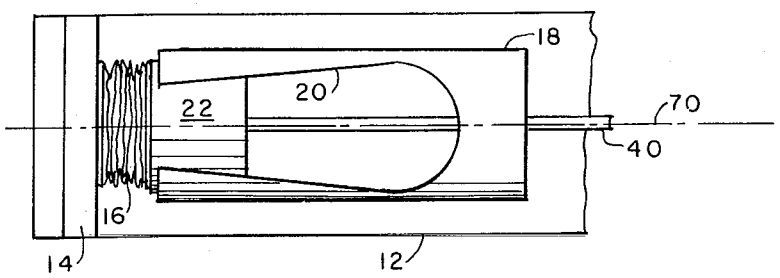
FIG. 4 is a top view of the cylindrical housing and anvil end of the article crushing apparatus of the present invention taken for FIG. 3 and illustrates the shape of the opening adapted to receive the article to be crushed.

With reference to FIG. 4, there is illustrated a top view of article crusher 10 of FIG. 3 showing the shape of opening 20. The shape of opening 20 is adapted to receive article or can 16, while, at the same time, remaining open along the top side of cylinder 18 down to its end proximate anvil 14. Thus, there is no edge of opening 20 in relation to piston 22 which can act in shear to injure the fingers or hand of an operator should piston 22 be prematurely moved toward anvil 14.

I claim:

1. An article crushing apparatus comprising a base support, an anvil bracket attached to said base support, means defining a cylindrical housing having means defining an opening adapted to receive an article to crushed, a piston disposed in said housing adapted to slidably move in said housing toward and away from said anvil bracket, an operating handle pivotally connected to said base support, and means connecting said operating handle to said piston for progressively increasing the ratio of force on said piston to moment-force on said operating handle as said piston approaches said anvil bracket, said last mentioned means comprising, a first linkage member having one end connected to said piston, a second linkage member having one end pivotally connected to the end of said first linkage member distal said piston, a third linkage member having one end pivotally connected to the other end of said second linkage member, the other end of said third linkage member being pivotally connected to said base support, and a fourth linkage member having one end pivotally connected to said third linkage member and with the other end of said fourth linkage member pivotally connected to said operating handle.

2. The article crushing apparatus as claimed in claim 1 wherein the distance between the pivotal connection proximate the ends of said fourth linkage member is less than the distance between the pivotal connection of said operating handle to said base support.

3. The article crushing apparatus as claimed in claim 1 wherein the distance between the pivotal connection of said fourth linkage member to said third linkage member and the pivotal connection of said third linkage member to said base support is greater than the distance between the pivotal connection of said fourth linkage member to said operating handle and the pivotal connection of said operating handle to said base support.

4. The article crushing apparatus as claimed in claim 1 wherein the angle defined by said second linkage member and said third linkage member becomes progressively greater as said piston moves toward said anvil bracket.

5. The article crushing apparatus as claimed in claim 1 wherein said first linkage member is fixedly attached to said piston, and said article crushing device further comprises means for guiding said first linkage member along a line of travel coincident with the longitudinal axis of said cylindrical housing.

6. The article crushing apparatus as claimed in claim 1 wherein the pivotal connection of said operating handle to said base support is offset from said pivotal connection of said third linkage member to said base support relative to the longitudinal axis of said cylindrical housing.

7. The article crushing apparatus as claimed in claim 1 wherein relative to the longitudinal axis of said cylindrical housing, the pivotal connection of said operating handle to said base support is closer to said longitudinal axis than the pivotal connection of said third linkage member to said base support.

8. The article crushing apparatus as claimed in claim 1 wherein the distance between said pivotal connections at each end of said second linkage member is greater than the distance between the pivotal connections at each end of said third linkage member.

* * * * *